United States Patent [19]

Mitter

[11] 4,368,667

[45] Jan. 18, 1983

[54] ROLLER SQUEEGEE FOR SCREEN PRINTING

[75] Inventor: Mathias Mitter, Schloss Holte, Fed. Rep. of Germany

[73] Assignee: Mitter & Co., Schloss Holte, Fed. Rep. of Germany

[21] Appl. No.: 177,459

[22] Filed: Aug. 11, 1980

[30] Foreign Application Priority Data

Aug. 23, 1979 [DE] Fed. Rep. of Germany ..... 2934059

[51] Int. Cl.[3] ..... B41L 13/00

[52] U.S. Cl. ..... 101/120

[58] Field of Search ..... 101/115-120, 101/49

[56] References Cited

U.S. PATENT DOCUMENTS

| | | | |
|---|---|---|---|
| 3,834,307 | 9/1974 | Zimmer | 101/116 |
| 3,934,502 | 1/1976 | Marino | 101/115 |
| 3,965,817 | 6/1976 | Ipek | 101/120 |
| 3,988,986 | 11/1976 | Zimmer | 101/119 |

FOREIGN PATENT DOCUMENTS

| | | | |
|---|---|---|---|
| 2101085 | 10/1971 | Fed. Rep. of Germany | 101/120 |

*Primary Examiner*—A. J. Heinz

*Attorney, Agent, or Firm*—Michael J. Striker

[57] ABSTRACT

A screen printing machine has a printing screen and above the same a roller squeegee including a stationary shaft and a tubular jacket which rotatably surrounds the shaft with clearance. Fluid pressure is exertable on the jacket of the squeegee roller in a direction away from the printing screen to counteract the weight of the jacket.

15 Claims, 5 Drawing Figures

ROLLER SQUEEGEE FOR SCREEN PRINTING

BACKGROUND OF THE INVENTION

This invention relates to screen printing in general, and more particularly to a roller squeegee for use in screen printing machines.

The invention also relates to screen printing machines having the novel roller squeegee.

The purpose of a roller squeegee in screen printing is to force the printing medium—ink, adhesives, foams, or any of the other substances which can be applied in this manner—through the openings of the screen (stencil). For this purpose the roller squeegee is located above a surface portion of the screen, which may be a flat screen or an endless (e.g. belt or drum type) screen. If the screen is of the endless type, the squeegee is located within the space surrounded by the screen. The workpiece to be printed, e.g. carpeting, rugs, textiles, or the like, is located beneath the screen and the roller squeegee rests on the screen; in fact, it is known in the case of endless printing screens to use magnets which actually draw the roller squeegee more firmly into contact with the screen, i.e. towards the workpiece. Since printing screens, especially those of the endless type, are very thin and would be easily deformed or otherwise damaged by the weight of the roller squeegee, the workpiece (and thus the screen) is supported from below by a counter roller, a worktable or a pressure beam. This prevents damage to the screen and, at the same time, assures uniform pressure of the squeegee roller via the screen on the workpiece.

From U.S. Pat. No. 4,106,407 (Mitter), which is incorporated herein in its entirety by reference, it is know to use a roller squeegee which can be pressed against the screen (and hence the workpiece) by internal fluid pressure to obtain uniform printing results over the entire width of the screen (i.e. length of the roller squeegee).

There are, however, circumstances—particularly certain types of workpiece materials—where the pressure exerted by the weight of the roller squeegee on the screen (and hence on the workpiece) is undesirable and can, in fact, be detrimental to good print quality. In such cases it is desirable that the squeegee contact the workpiece via the interposed screen as uniformly as possible over the entire screen width, but that it exert no pressure or substantially no pressure at all. This has not heretofore been possible.

SUMMARY OF THE INVENTION

It is, accordingly, an object of the invention to further improve on the prior art.

A more particular object is to provide a roller squeegee for screen printing which can operate while exerting no—or substantially no—pressure upon the printing screen and the underlying workpiece.

In keeping with these objects, and still others which will become apparent hereafter, one aspect of the invention resides in a roller squeegee for use with printing screens with which it defines a printing line, i.e. a line of contact. Briefly stated such a roller squeegee may comprise a stationary shaft, a tubular jacket rotatably surrounding the shaft with clearance, and means for applying to the jacket fluid pressure within the space surrounded by the jacket and in a direction away from the printing line.

Another aspect of the invention resides in a screen printing machine which, in accordance with the invention, may comprise a combination of a printing screen having a surface, and a roller squeegee proximal to the surface and defining therewith a printing line for causing a printing medium to penetrate through the screen, the roller squeegee comprising a stationary shaft spaced from and extending along the surface, a tubular jacket rotatably surrounding the shaft with clearance, and means for applying to the jacket fluid pressure within the space surrounded by the jacket and acting in a direction away from the screen.

By resorting to the invention the roller squeegee can, in effect, be made to "float" with reference to the workpiece so that the latter is subjected to no pressure, or only to at most negligible pressure.

Roller squeegees, particularly when they are rather long (i.e. for use with printing screens having a width of e.g. 4 meters or more) will sag (hang through) towards the middle of the squeegee as a result of their inherent weight. In the prior art, where the weight of the squeegee rests fully upon the counter roller, table or pressure beam via the screen and workpiece, this tendency is compensated. That is not the case, however, if the squeegee is not to be allowed to exert pressure upon the workpiece. For example, if a high-nap workpiece is to be printed under conditions in which the squeegee and screen just touch the tips of the nap, there is nothing to prevent roller squeegee sag. This would cause heavy printing medium (hereafter called "ink" for simplicity and without implying limitations) application by the middle portion of the squeegee (where the degree of sag is most pronounced) and much ligher application at the end regions of the squeegee. This thus-printed workpiece would as a rule have to be discarded. The present invention, however, compensates for this sag and allows the squeegee to be so adjusted that absolutely uniform ink application is obtained over the entire width of the workpiece.

A very important aspect of the invention resides in its effect on the screen printing of nap-type workpieces, particularly workpieces having a high nap. Due to the absence of pressure from the squeegee upon the workpiece, the nap of the workpiece—e.g. cut pile threads—is standing upright at the time of ink application and receives the ink from above so that the ink travels from the free tips of the nap-forming threads or loops along the threads or loops and down into the substrate. This means that the wedge-shaped pool of ink from which the squeegee derives the ink it squeezes through the screen, does not yield up its ink to crushed-down threads or loops (which usually are folded over in several different directions), but to the upstanding nap. This eliminates pattern blurring which is frequently found in the prior art. Evidently, other types of workpieces can also be printed with the aid of the invention, but the advantages obtained with the invention are at their most striking in the printing of high-nap textiles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
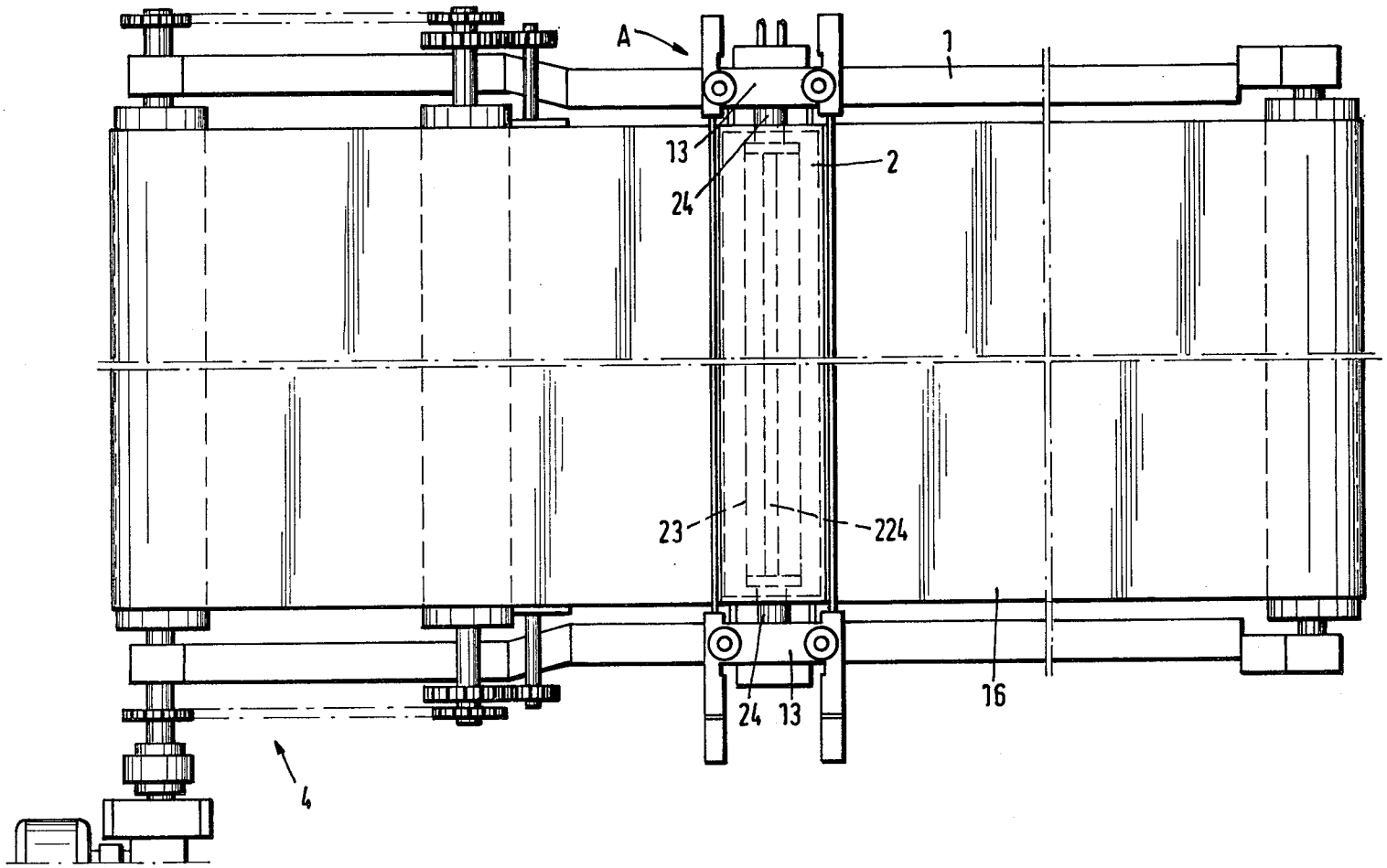
FIG. 1 is a top-plan view of a screen printing machine embodying the invention.

Referring now to the drawing in detail, and firstly to FIG. 1 thereof, it will be seen that this Figure illustrates in somewhat diagrammatic form a screen printing machine having a frame or base 1 on which at least one printing station A is provided (there could be two or more, e.g. for multi-color printing). The station A has an endless tubular rotary (drum-type) printing screen 2. The machine is driven by a drive 4 which, inter alia, drives a printing blanket 16 which travels in an endless path. The workpiece(s) which are not visible in FIG. 1, rest on printing blanket 16 and travel with it beneath the printing station A to be printed thereat with a printing medium (e.g. ink).

Figure 3:
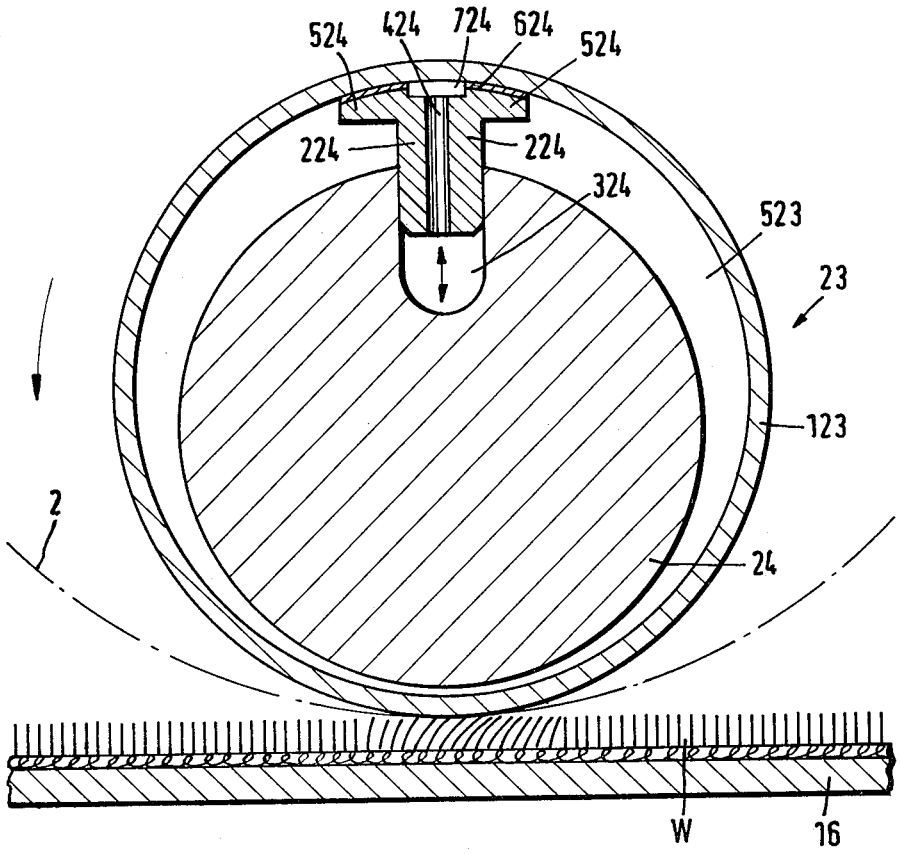
FIG. 3 is a vertical cross-section through an embodiment of a roller squeegee according to the invention.

Mounted within the confines of the printing screen 2 is a roller squeegee 23 having a stationary shaft 24 which is surrounded with clearance by a rotary jacket 123 (cf. FIG. 3, which will be described subsequently). This roller squeegee is of the type according to the invention, i.e. internal pressure can be applied to it in a manner still to be discussed. The manner in which such pressure is applied can vary, which is to say that various different structural solutions may be employed. Similarly, the overall printing machine construction shown in FIG. 1 need not be as illustrated, but can differ. For example, the invention is applicable not only with tubular printing screens but also with flat screens or with endless belt-type screens which are trained about usually three triangularly arranged rollers (all known per se). In the event a flat screen is used, the roller squeegee may be installed on a carriage and moved in a path to and fro over the (stationary) screen, or else the squeegee may be stationary (in space) and the screen be moved to and fro relative to it.

Figure 2:
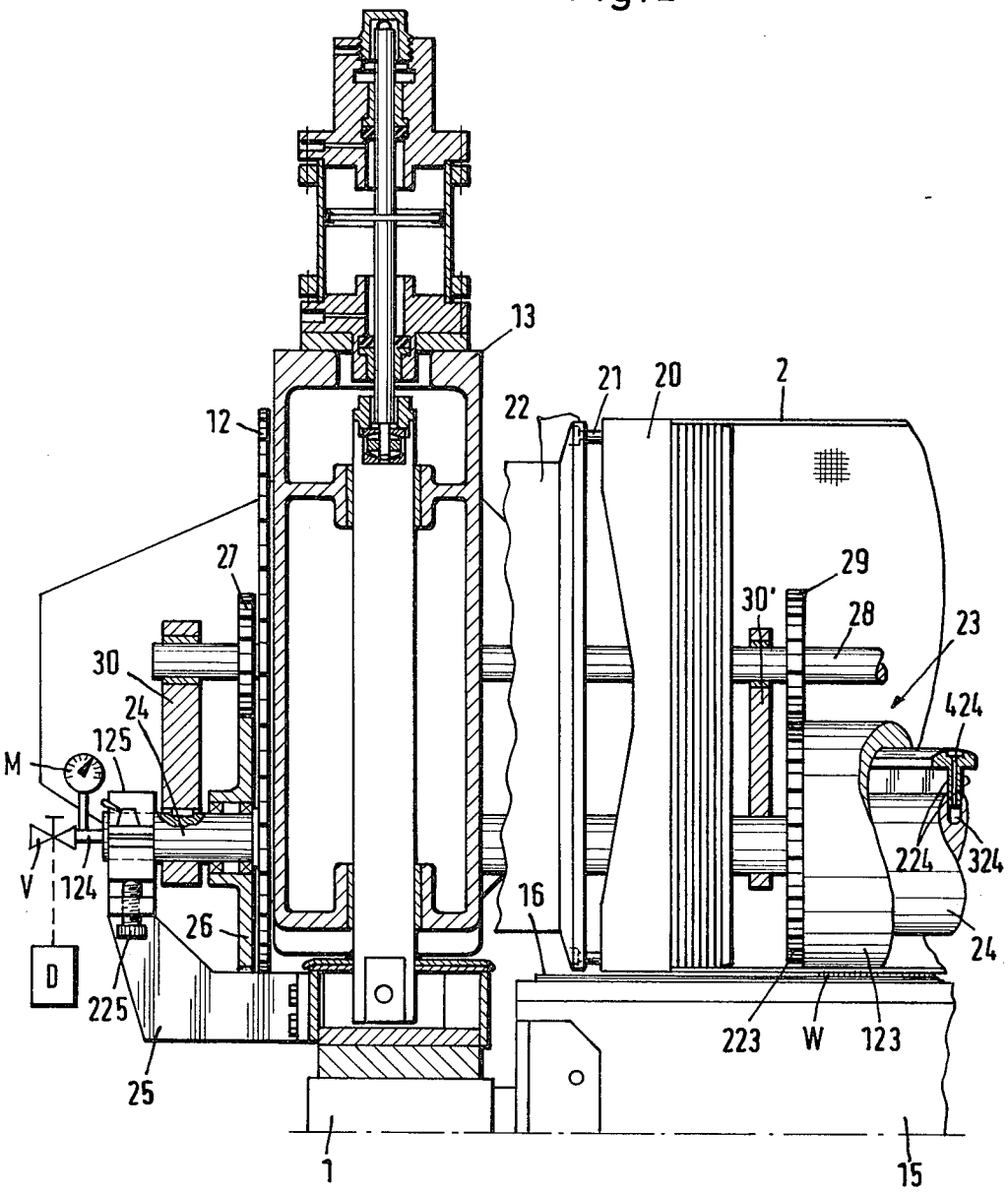
FIG. 2 is a fragmentary vertical section through a portion of the machine in FIG. 1.

Returning to the drawing, it will be seen that details of the mounting for the tubular screen 2 and the roller squeegee 23 are shown in FIG. 2. Each of the two ends of screen 2 (only one end is shown, since this suffices for an understanding) is connected to an end ring 20 having a plurality of circumferentially spaced axially projecting pins or bolts 21 which are engageable with a support sleeve 22. The axially outer end of sleeve 22 carries a gear 12 via which it—and thereby the screen 2—can be rotated. The sleeves 22 are turnably supported in end supports 13 which in turn can be raised and lowered, shifted in and opposite to the direction of travel of workpieces W (normal to the plane of FIG. 2) and also shifted transverse to this direction of travel (i.e. left-right in FIG. 2), so that the screen 2 can be precisely adjusted relative to the workpiece path. The basic arrangement shown in FIG. 2, except for the details associated with the inventive roller squeegee, are known from U.S. Pat. No. 4,106,407 to which reference may be had.

The sleeves 22 are hollow (i.e. tubular) in the illustrated embodiment and the supply and/or removal of various working media is effected through them. For example, the ink supply tube 19 (shown in FIG. 5 which will be discussed later) passes through sleeve 22 and receives its ink (or other printing medium) via a hose or hoses 219 (one shown) and pump or pumps 319 (one shown) from a supply F. This is also known per se.

Figure 4:
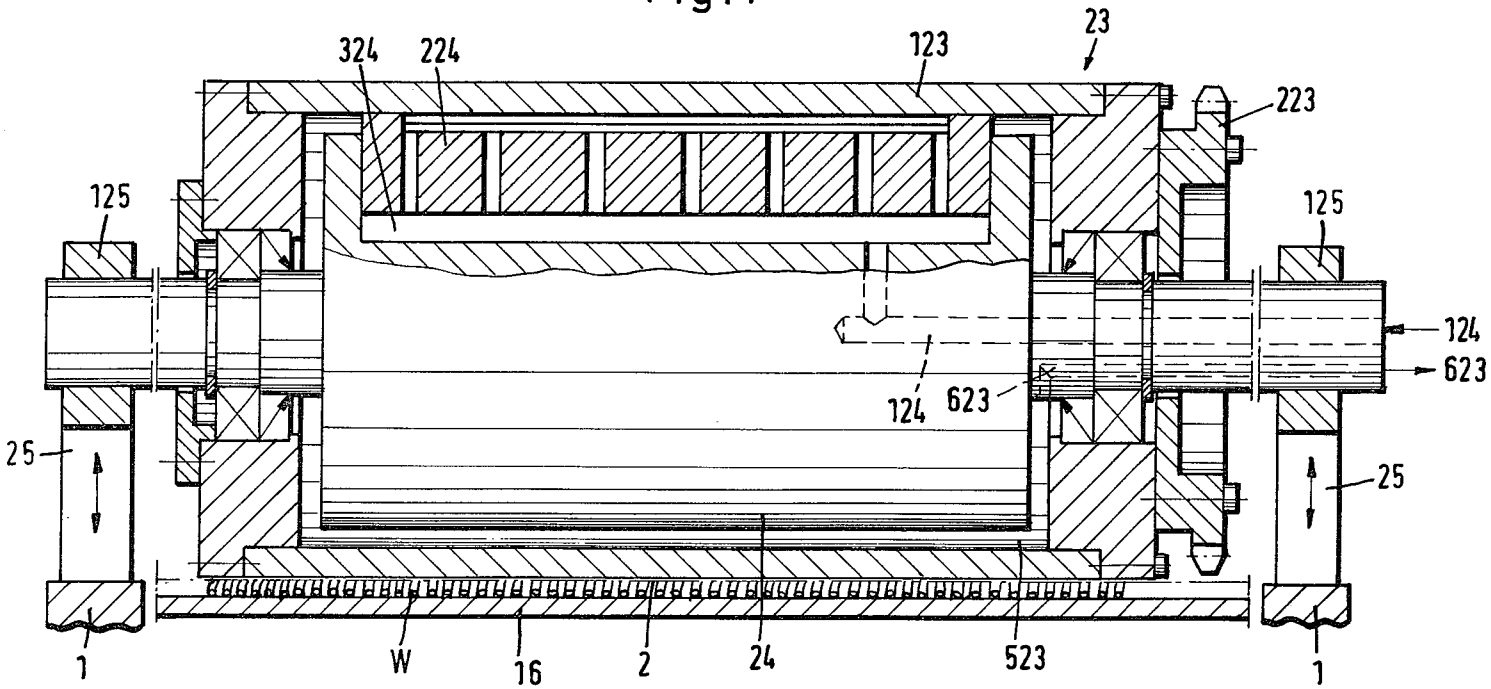
FIG. 4 is a fragmentary vertical section through the roller squeegee of FIG. 3, including an illustration of the journals for it.

In the illustrated embodiment the squeegee roller 23 according to the invention is located within the space surrounded by the screen 2 (if the screen were a flat one, roller 23 would be located atop it). The squeegee has a stationary shaft 24 the opposite ends of which extend outwardly beyond the axial ends of screen 2, through the bearings 13, and are mounted in separate bearings 125. FIG. 4 shows a very simple embodiment of this solution, wherein separate bearing supports 25 mounted on frame 1 are continuously height-adjustable. They in turn hold bearings 125 so that shaft 24 can be raised and lowered. In FIG. 2 the bearings 125 are connected to the bearings 13 instead, so that raising and lowering of supports 25 causes the entire squeegee roller to move correspondingly; however, the bearings 125 are themselves independently adjustable, e.g. via the illustrated screws 225, so that a precise adjustment of the squeegee roller 23 relative to the screen 2 is possible.

It is clear that it is important to be able to adjust the squeegee roller 23 relative to the screen 2, irrespective of the shape of the latter, in such a manner that there is contact between them. Equally important is, of course, to be able to adjust the screen and the squeegee roller together (as a unit) relative to the workpiece. By appropriately combining these adjustments the roller and screen can be made to just touch the tips of e.g. the nap of a napped textile (such as a carpet or the like) without causing the nap to be deformed by their weight, or with only the very slightest deformation. In view of the upwardly directed pressure to be applied to the squeegee roller, no sag of the roller occurs anywhere over its entire length (i.e., the entire workpiece width) so that the printing of workpieces is absolutely uniform over their entire width.

The shaft 24 of roller 23 is surrounded with clearance by the rotatable tubular jacket 123, against which the aforementioned pressure acts from the interior of the roller 23 (in direction away from the line of contact with the screen 2), whereby the inherent sag of the jacket 123 (under its own weight) is compensated.

At least one end (preferably both ends) of the jacket 123 is provided with an external annulus of gear teeth 223 (FIGS. 2, 4). A freely turnable gear 26 is journalled on the stationary shaft 24 (preferably there are two gears, one at each shaft end) and is suitably driven in known manner requiring no illustration, either by the overall machine drive or by a separate drive provided for this purpose. If the jacket 123 is to be driven at both of its axial ends, then the gear 26 meshes with another gear 27 mounted on and for rotation with a shaft 28 which extends through both of the end bearings 13 and through the space surrounded by the screen 2. Gears 29 (one shown in FIG. 2) are mounted on shaft 28 for rotation therewith and mesh with the annuli of teeth 223 of jacket 123. Two bearings 30, 30' serve to maintain the desired spacing between the shafts 24 and 28. It should be understood that the foregoing is merely exemplary of the drive for the roller squeegee 23, since other solutions are possible also, just as the screws 235 for height adjustment of the bearings 125 could be replaced by other means, e.g. cylinder and piston units.

The application of pressure fluid to the jacket 123 (instrumentalities will be discussed subsequently) serves, as mentioned before, to compensate for the inherent sag of the jacket due to its own weight. It should be understood that the term "compensation" is not limited to absolute compensation of the sag, i.e. to produce a completely straight line of contact of jacket 123 with the screen 2; compensation can also be so selected that the jacket is accommodated to e.g. a pressure beam 15 which is not exactly linear (in direction transverse to the movement of the workpiece W) so that the tips of e.g. the nap of the workpiece are not all located in a common plane as considered in this direction.

The application of pressure to the jacket 123 can be effected in several ways. For example, in FIGS. 1–4 the shaft 24 is formed at its side facing away from the contact line between jacket 123 and screen 2, with a longitudinally extending chamber 324. Flowable pressure medium is admitted into this chamber from outside the confines of roller squeegee 23 and screen 2, via a supply conduit 124. Chamber 324 is open towards the inner surface of jacket 123 and is provided with lateral sealing strips 224 which limit the area of pressure medium impingement to the inner surface portion of jacket 123 which is located opposite the chamber 324, i.e. opposite the line of contact between jacket 123 and screen 2. Advantageously, the strips 224 are integral with one another, i.e. in form of a bar-shaped member partly received in the chamber 324 and provided over its length with a plurality of openings 424 (cf. FIGS. 3 and 4) which further limit the impingement area of the pressure medium on jacket 123. Since the sidewalls of chamber 324 are parallel and the sidewalls of the member forming the sealing strips 224 are also parallel, this member can shift in the chamber 324 in the direction indicated by the double-headed arrow in FIG. 3 and also has some freedom of movement axially of the chamber 324. Its radially outer surfaces are in sealing but sliding engagement with the inner surface of jacket 123.

Pressure in the chamber 324 can be continuously adjusted by appropriate known per se means, for example by adjustment of the pressure-medium supply unit D. The combined surface area of the member or members 224 which is exposed in the chamber 324 to the action of the pressure medium, is larger than the effective area at which pressure medium acts upon the inner surface of the jacket 123, so that the member (or members) 224 will be urged outwardly of chamber 324 and be sealingly pressed into engagement with the inner surface of jacket 123. The chamber 324 does not extend over the entire length of the shaft 24 (FIG. 4) and the member or (members) 224 has end seals at the ends of the chamber; it may also cooperate with a separate additional seal of chamber 324 (not shown). Member or members 224 may have lateral shoulders 524 which may carry seals 624 and be shaped so as to be accommodated to the contour of the inner surface of jacket 123. Especially (but not exclusively) if a single member 224 is used, the same may have a longitudinal recess 724 open to the inner surface of jacket 123 and with which the openings 424 communicate, as shown in FIG. 3. The clearance 523 (FIG. 4) between shaft 24 and jacket 123 is provided with an outlet (e.g. suction) conduit 623 which extends through the stationary shaft 24 to the exterior of roller 23 and screen 2.

Figure 5:
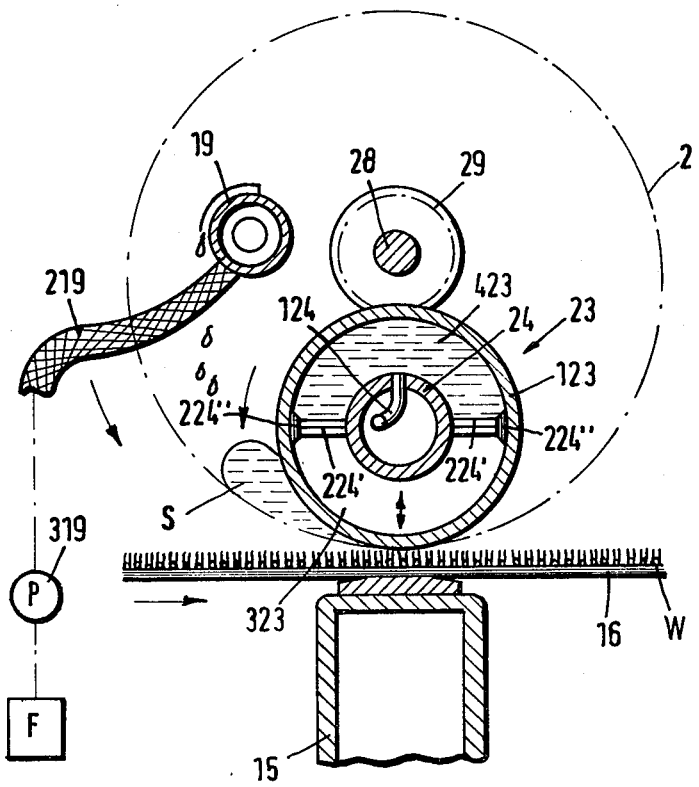
FIG. 5 is a view analogous to FIG. 3 but illustrating in simplified form still another embodiment of the roller squeegee according to the invention.

The embodiment in FIG. 5 is structurally different from the one in FIGS. 1–4, but the concept of a stationary shaft, a rotatable jacket and a pressure-medium supply acting upon the jacket in direction away from the line of contact with the printing screen, is the same as before.

Like reference numerals have been used in this embodiment to identify elements which are the same as in the preceding Figures. Here, however, sealing strips 224' are provided which project radially or substantially radially from opposite lateral sides of the shaft 24 across the clearance between the shaft and the jacket 123. These strips extend lengthwise of shaft 24 and are of deformation-resistant material, e.g. a metal such as steel. Their radially outer ends carry strip-shaped seals 224'' of e.g. natural or synthetic rubber or synthetic plastic material which sealingly but slidably engage the inner surface of the jacket 123. The clearance between shaft 24 and jacket 123 is thus subdivided into a lower chamber 323 and an upper pressure-medium chamber 423 which is of relatively large volume and which is, of course, closed at its axial ends (not shown). Pressure medium is supplied into the chamber 423 via the conduit 124, as in the preceding Figures, except that here it fills the relative large chamber 423; it is on this pressure medium cushion that the jacket 123 is supported so that sagging is compensated. Even if the shaft 24 should flex under the pressure and/or the weight of the jacket, the jacket itself will not sag so that there is no or almost no application of weight to the screen 2 and the workpiece W.

The mounting of roller 23 and of screen 2, and their adjustments (relative to one another and jointly with reference to the workpiece) can be the same in this embodiment as in FIGS. 1–4. Pressure medium can be supplied to the conduit 124 in any known per se manner, for example (as in FIG. 2) from the source D via a valve V and a manometer M. Ink may be supplied from a reservoir F via a regulatable pump 319 and a conduit 219 into the ink tube 19, from where it is discharged into the ink pool S which is of substantially wedge-shaped cross-section and located ahead (upstream) of the squeegee roller 23.

Jacket 123 can be positively driven in rotation as in FIGS. 1–4; this is generally preferable because it enables the operator to select rotation of the screen 2 and jacket 123 at identical or at different circumferential speeds, depending upon the requirements of a particular printing operation. However, in this embodiment as well as in FIGS. 1–4, it is also possible to have the jacket 123 be rotated passively, i.e. only due to friction between it and the driven screen 2; in this case, the ink pressure in pool S must be taken into account.

Although the invention has been described hereinbefore with reference to a tubular printing screen 2, its use is not limited thereto. The squeegee roller 23 can also be used with flat screens and with endless belt-type screens, both of which are known per se. Any desired kinds of workpieces can be printed, using the present invention. The workpieces may be supported on an endless travelling printing blanket. The invention is of particular advantage in the printing of high-nap textiles (e.g. rugs, carpets or the like), since it does not cause the nap to be bent over or crushed down, beyond the slight surface contact required for proper printing. Because of this, the invention is also suitable for printing of such delicate, easily crushed textiles as velvet and analogous materials.

While the invention has been illustrated and described as embodied in a squeegee roller for screen printing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims:

1. A roller squeegee for use with printing screens having a surface with which it defines a printing line, comprising a stationary shaft; a tubular jacket rotatably surrounding said shaft with a clearance; and means for applying to said jacket fluid pressure from the interior of said jacket outwardly and in a direction away from said printing line, said applying means comprising a longitudinally extending groove in the periphery of said shaft at a side thereof which faces away from said surface, a glide shoe received in said groove and having an outer surface engaging an inner surface of said jacket, and means for admitting pressure fluid into said groove beneath said glide shoe so as to cause the glide shoe to emerge from the groove to a selectable extent.

2. A roller squeegee as defined in claim 1 and further comprising means for rotating said jacket with reference to said shaft.

3. A roller squeegee as defined in claim 1, wherein the roller squeegee is arranged to cooperate with the printing screen and is spaced from the latter by a distance; and further comprising means for varying the distance between said shaft and the printing screen with which said roller squeegee cooperates.

4. A roller squeegee as defined in claim 1, wherein said jacket has a given weight and is arranged to apply said weight onto the screen, said applying means being arranged to substantially compensate for said weight of said jacket.

5. In a screen printing machine, a combination comprising a printing screen having a surface; and a roller squeegee proximal to said surface and defining therewith a printing line for causing a printing medium to penetrate through said screen, said roller squeegee comprising a stationary shaft spaced from and extending along said surface, a tubular jacket rotatably surrounding said shaft with a clearance; and means for applying to said jacket fluid pressure and acting in a direction away from said printing line, said applying means comprising a longitudinally extending groove in the periphery of said shaft at a side thereof which faces away from said surface, a glide shoe received in said groove and having an outer surface engaging an inner surface of said jacket, and means for admitting pressure fluid into said groove beneath said glide shoe so as to cause the glide shoe to emerge from the groove to a selectable extent.

6. A combination as defined in claim 5; and further comprising means for positively rotating said jacket with reference to said shaft.

7. A combination as defined in claim 5, wherein said shaft is spaced from said surface by a distance; and further comprising means for varying said distance between said shaft and said surface.

8. A combination as defined in claim 5, wherein said jacket is freely turnable relative to said shaft.

9. A combination as defined in claim 5, said glide shoe having a plurality of passages communicating said outer surface with the interior of said groove, so that pressure fluid flows from said groove of said shaft through said passages of said guide shoe to said jacket to apply fluid pressure to the latter in the direction away from the printing line.

10. A combination as defined in claim 5, wherein said printing screen is in form of an endless stencil.

11. A combination as defined in claim 5, wherein said jacket has a given weight and is arranged to apply said weight onto said screen, said applying means being arranged to substantially compensate for said weight of said jacket.

12. A roller squeegee for use with printing screens with which it defines a printing line, comprising a stationary shaft which is hollow and has at least one opening communicating its interior with its periphery at a location diametrally opposite said printing line; a tubular jacket rotatably surrounding said shaft with a clearance; means for applying to said jacket fluid pressure from the interior of said jacket outwardly and in a direction away from said printing line; and subdividing means on said shaft extending into sealing and sliding engagement with an inner peripheral surface of said jacket and subdividing said clearance into a first chamber proximal to and a second chamber distal from said printing line, said opening communicating with said second chamber and said applying means communicating via said hollow shaft and said opening with said second chamber, so that pressure fluid flows from said opening of said shaft into said second chamber of said jacket to apply fluid pressure to the latter in the direction away from said printing line.

13. A roller squeegee for use with a printing screen having a surface to be applied onto an object to be printed on, in a predetermined direction, comprising a stationary shaft; a tubular jacket rotatably surrounding said shaft with a clearance; and means for applying to said jacket fluid pressure from the interior of said jacket outwardly and in a direction opposite to the direction in which the screen is to be applied onto the object, said applying means comprising a longitudinally extending groove in the periphery of said shaft at a side thereof which faces away from said surface, a glide shoe received in said groove and having an outer surface engaging an inner surface of said jacket, and means for admitting pressure fluid into said groove beneath said glide shoe so as to cause the glide shoe to emerge from the groove to a selectable extent.

14. In a screen printing machine, a combination comprising a printing screen having a surface; and a roller squeegee proximal to said surface and defining therewith a printing line for causing a printing medium to penetrate through said screen, said roller squeegee comprising a hollow stationary shaft spaced from and extending along said surface and having at least one opening communicating its interior with its periphery at a location diametrally opposite said printing line, a tubular jacket rotatably surrounding said shaft with a clearance, and means for applying to said jacket fluid pressure and acting in a direction away from said printing line, and subdividing means on said shaft extending into sealing and sliding engagement with an inner peripheral surface of said jacket and subdividing said clearance into a first chamber proximal to and a second chamber distal from said printing line, said opening communicating with said second chamber and said applying means communicating via said hollow shaft and said opening with said second chamber, so that pressure fluid flows from said opening of said shaft into said second chamber of said jacket to apply fluid pressure to the latter in the direction away from the printing line.

15. In a screen printing machine, a combination comprising a printing screen having a surface to be applied onto an object to be printed on, in a predetermined direction; and a roller squeegee proximal to said surface and defining therewith a printing line for causing a printing medium to penetrate through said screen, said roller squeegee comprising a stationary shaft spaced from and extending along said surface, a tubular jacket rotatably surrounding said shaft with a clearance, and means for applying to said jacket fluid pressure from the interior of said jacket outwardly and acting in a direction opposite to the direction in which said surface of said screen is to be applied onto the object, said applying means comprising a longitudinally extending groove in the periphery of said shaft at a side thereof which faces away from said surface, a glide shoe received in said groove and having an outer surface engaging an inner surface of said jacket, and means for admitting pressure fluid into said groove beneath said glide shoe so as to cause the glide shoe to emerge from the groove to a selectable extent.

* * * * *